US008356375B2

(12) United States Patent
Geurkink

(10) Patent No.: US 8,356,375 B2
(45) Date of Patent: Jan. 22, 2013

(54) FLOOR TREATING SYSTEM AND METHOD

(76) Inventor: John Franklin Geurkink, Winchester, KY (US)

( * ) Notice: Subject to any disclaimer, the term of this patent is extended or adjusted under 35 U.S.C. 154(b) by 379 days.

(21) Appl. No.: 12/815,523

(22) Filed: Jun. 15, 2010

(65) Prior Publication Data

US 2010/0319147 A1 Dec. 23, 2010

Related U.S. Application Data

(60) Provisional application No. 61/218,919, filed on Jun. 19, 2009.

(51) Int. Cl.
*A47L 11/03* (2006.01)
*A47L 11/12* (2006.01)

(52) U.S. Cl. ..... 15/50.1; 15/49.1; 15/98; 451/350; 451/353; 451/357

(58) Field of Classification Search ..... 15/49.1, 15/50.1, 50.2, 52.2, 98, 180; 451/350, 353, 451/357, 360
See application file for complete search history.

(56) References Cited

U.S. PATENT DOCUMENTS

| | | | | |
|---|---|---|---|---|
| 2,626,412 | A * | 1/1953 | Petersen | 15/50.1 |
| 2,832,978 | A * | 5/1958 | Mann et al. | 15/50.1 |
| 3,348,254 | A | 10/1967 | Storm et al. | |
| 3,416,177 | A | 12/1968 | Young | |
| 3,482,362 | A * | 12/1969 | Bangerter et al. | 451/357 |
| 4,610,111 | A * | 9/1986 | Cox | 451/357 |
| 5,355,542 | A | 10/1994 | Oreck et al. | |
| 6,938,295 | B1 | 9/2005 | Lancaster et al. | |
| 2006/0150362 | A1 | 7/2006 | Mitchell | |

* cited by examiner

*Primary Examiner* — Mark Spisich
*Assistant Examiner* — Andrew A Horton
(74) *Attorney, Agent, or Firm* — Stoll Keenon Ogden, PLLC; Rebecca Ann Krefft

(57) ABSTRACT

A floor treating system is provided including a power source having a rotatable drive shaft with an axis of rotation, a floor treating attachment, means for imparting an oscillating motion from the drive shaft to the floor treating attachment, a rug beating attachment, and means for imparting a vibrating motion from the drive shaft to the rug beating attachment. Multiple embodiments provide that the means for imparting an oscillating motion impart at least two speeds of oscillating motion. Embodiments include those with means for connecting floor treating attachments at at least two different distances from the drive shaft axis of rotation.

20 Claims, 4 Drawing Sheets

FLOOR TREATING SYSTEM AND METHOD

CROSS-REFERENCE TO RELATED APPLICATIONS

This application claims priority to U.S. Provisional Application No. 61/218,919, entitled "Variable speed orbital machine" and filed on Jun. 19, 2009.

MULTIPLE EMBODIMENTS AND ALTERNATIVES

Figure 1:
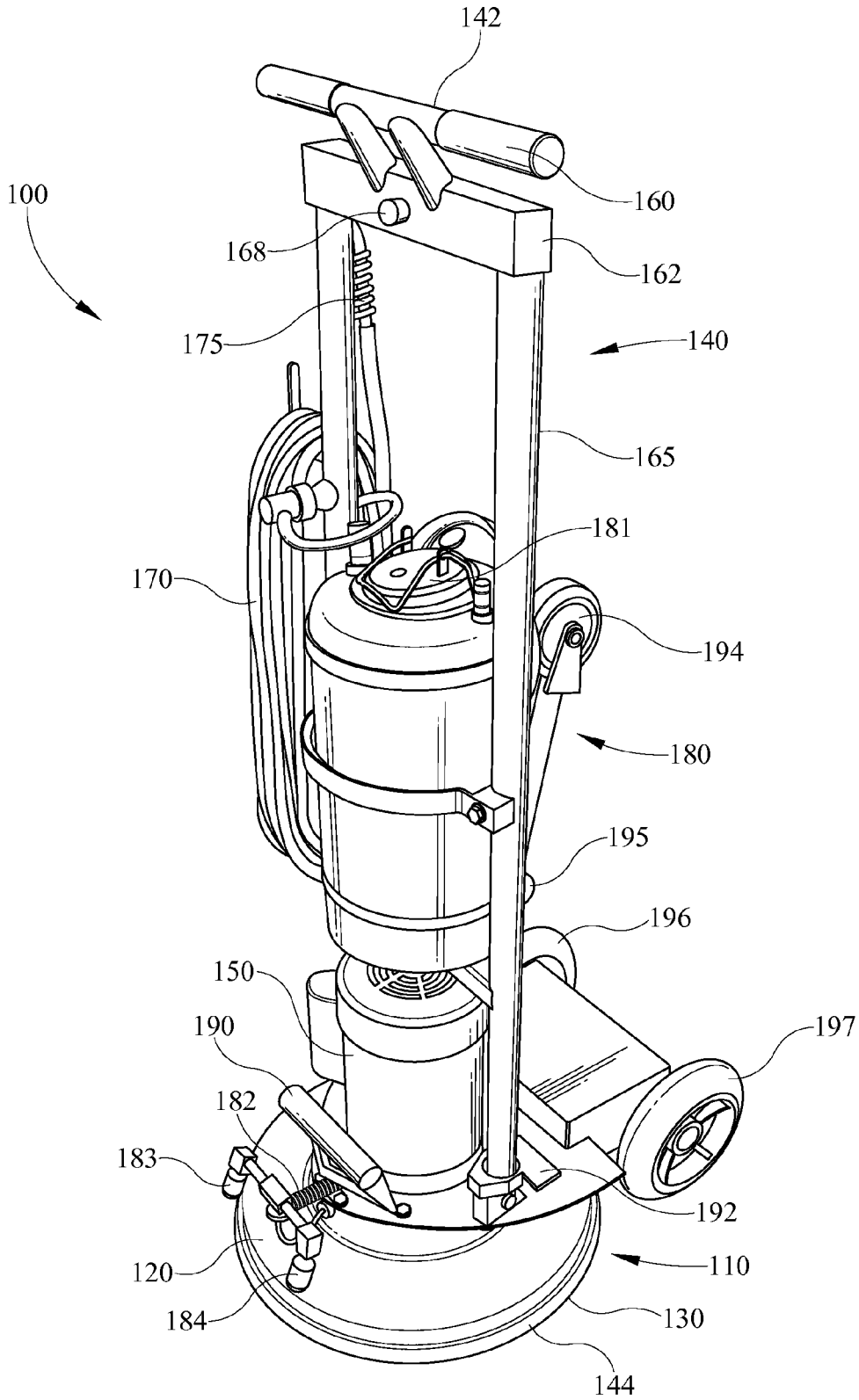
FIG. 1 is a perspective view of a floor treating system according to multiple embodiments and alternatives.
Figure 2:
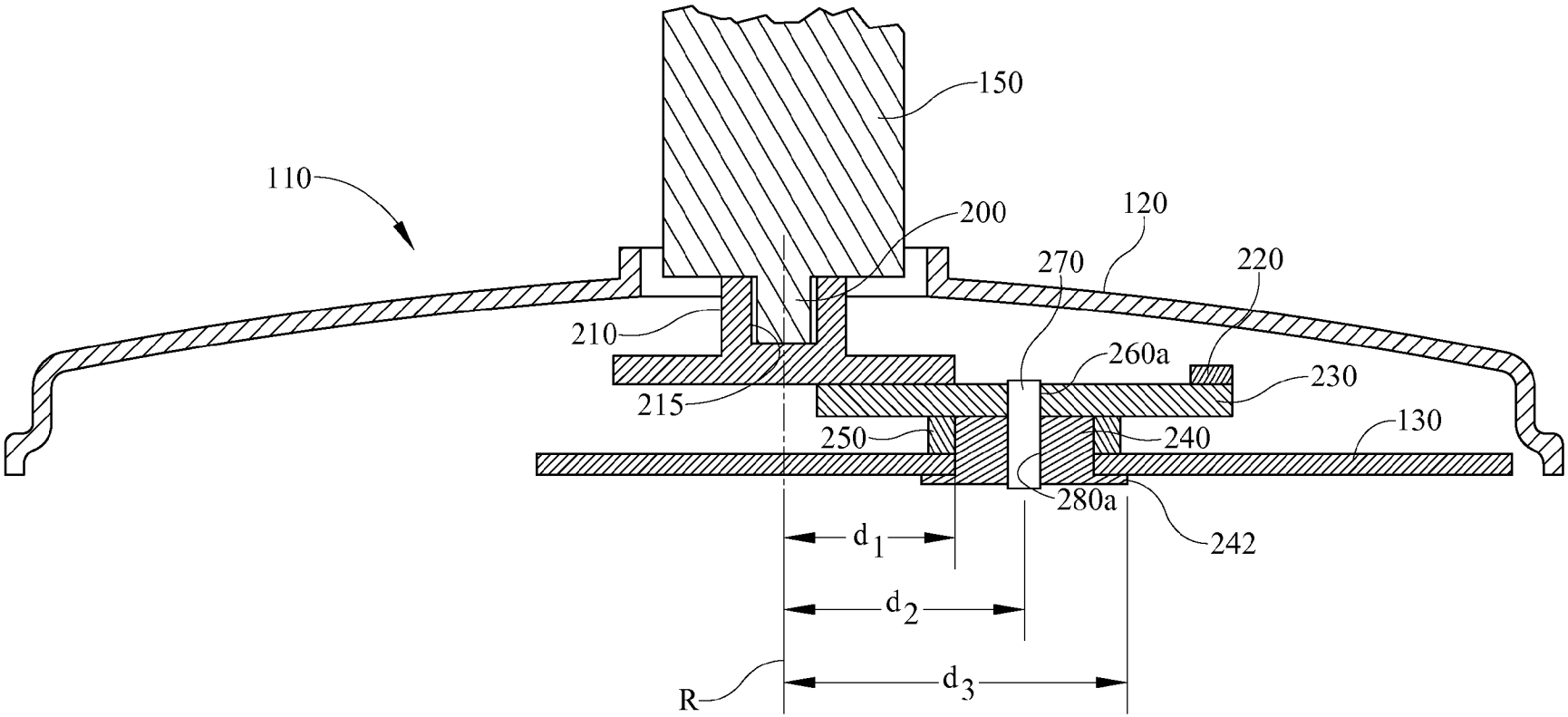
FIG. 2 is a cutaway side view of a bottom portion of a floor treating system with a floor treating attachment according to multiple embodiments and alternatives.

Turning now to the drawings and, more particularly to FIG. 1, a floor treating system according to multiple embodiments and alternatives is illustrated generally at 100 and includes a bottom portion 110. An embodiment of the bottom portion 110 of the floor treating system 100 is further illustrated in FIG. 2. As shown in FIG. 2, the bottom portion 110 includes a power source 150 with a rotatable drive shaft 200, a floor treating attachment 130, and means for imparting at least two speeds of oscillating motion from the drive shaft 200 to the floor treating attachment 130. The floor treating attachment 130 may be any of a number of conventional floor treating attachments commonly utilized in floor treating systems, such as a carpet cleaning attachment, a tile cleaning brush, a hardwood sanding attachment, or a vinyl composition tile (VCT) stripping attachment, for example. The power source 150 may be any of a number of conventional power sources commonly utilized in floor treating systems, such as a motor, for example.

Returning to FIG. 1, multiple embodiments of the floor treating system 100 include a housing assembly 140 with a proximal end 142 and a distal end 144. The housing assembly 140 may be manufactured from conventional materials commonly utilized in floor treating system housings including, but not limited to, anodized aluminum, stainless steel, and nickel. The floor treating system 100 may also include a brush cover 120, and the brush cover 120 may be manufactured from conventional materials commonly utilized in floor treating system brush covers including, but not limited to, anodized aluminum, stainless steel, and nickel. The floor treating system 100 may further include a handle assembly 165 with a handle 160 and a handle plate 162. Any electrical wiring may be enclosed in the handle assembly 165 and behind the handle plate 162. Additionally, the floor treating system 100 may include an on and off switch 168, an electrical cord 170, a strain relief 175 on the electrical cord 170, a lifting handle 190, a kickstand 192, and wheels 194, 196, and 197. The wheel 194 may be adjustably mounted onto the housing assembly 140 with an adjustable knuckle 195, which may adjusted in increments of ten degrees, for example.

Multiple embodiments of the floor treating system 100 include a spray system 180, which may include a spray tank 181, a spring 182, and spray heads 183 and 184. The spray tank 181 may be mounted on the housing assembly 140 and may be manufactured from a material resistant to corrosion, such as stainless steel or titanium, for example. The spray heads 183 and 184 may be mounted on the housing assembly 140 with the spring 182, thereby reducing damage to the spray heads 183 and 184 and to walls, and may be manufactured from a non-marring material, such as a polymer, for example, thereby reducing marring to walls from the spray heads 183 and 184. Also, the wheel 194 may be configured to bear the load of the spray tank 181 and to facilitate maneuvering of the floor treating system 100. The spray system 180 may also include a pump (not shown) and hose assembly (not shown), which may be substantially enclosed in the housing assembly 140. Additionally, the pump may be located between the spray heads 183 and 184 and the distal end 144 of the housing assembly, thereby reducing any leakage of fluid from the spray heads 183 and 184. The pump may also be located between the spray tank 181 and the distal end 144 of the housing assembly the spray tank 181. Also, the spray tank 181 may be sealed, thereby further reducing any leakage of fluid from it.

As illustrated in FIG. 2, in multiple embodiments of the bottom portion 110, the rotatable drive shaft 200 of the power source 150 rotates around an axis of rotation R. In some embodiments, the means for imparting at least two speeds of oscillating motion from the drive shaft 200 to the floor treating attachment 130 comprise a flywheel 210 having an aperture 215 to receive the drive shaft 200, a counterbalance 230 configured to connect to the flywheel 210, and means for connecting the floor treating attachment 130 to the counterbalance 230 at at least two different distances from the axis of rotation R. For example, the means for connecting the floor treating attachment 130 to the counterbalance 230 may be configured to connect the floor treating attachment 130 to the counterbalance 230 at a distance $d_1$ from the axis of rotation R, at a distance $d_2$ from the axis of rotation R, and at a distance $d_3$ from the axis of rotation R. Each distance from the axis of rotation R corresponds to a different speed of oscillating motion that may be imparted from the drive shaft 200 to the floor treating attachment 130. In multiple embodiments, the drive shaft 200 of the power source 150 rotates the flywheel 210 around the axis of rotation R, the rotation of the flywheel 210 provides motion to the counterbalance 230, and the motion of the counterbalance 230 imparts an oscillating motion to the floor treating attachment 130 through the means for connecting the floor treating attachment 130 to the counterbalance 230.

In some embodiments, the bottom portion 110 also includes a counterweight 220, or a number of counterweights, configured to attach to the counterbalance 230. Additionally, the means for connecting the floor treating attachment 130 to the counterbalance 230 comprise a plug bearing 240, a spacer 250, and a bolt 270, in some embodiments. The plug bearing 240 may have a lip 242 that extends over part of the floor treating attachment 130 to assist in connecting the floor treating attachment 130 to the counterbalance 230, while the remainder of the plug bearing 240 is positioned between the floor treating attachment 130 and the counterbalance 230. In multiple embodiments, the drive shaft 200 of the power source 150 rotates the flywheel 210 around the axis of rotation R, the rotation of the flywheel 210 provides motion to the counterbalance 230, and the motion of the counterbalance 230 imparts an oscillating motion to the floor treating attachment 130 through the plug bearing 240.

Figure 3:
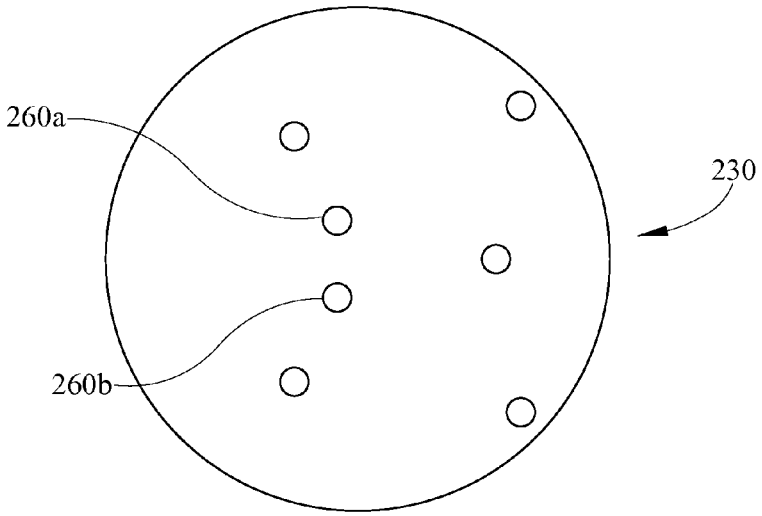
FIG. 3 is a top plan view of a counterbalance according to multiple embodiments and alternatives.
Figure 4:
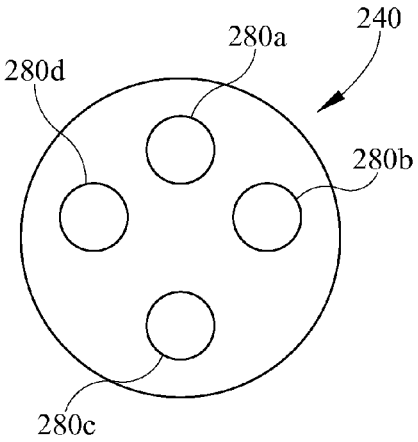
FIG. 4 is a top plan view of a plug bearing according to multiple embodiments and alternatives.
Figure 5:
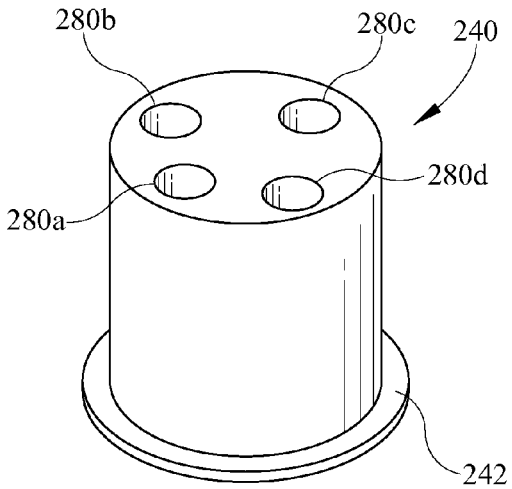
FIG. 5 is a perspective view of a plug bearing according to multiple embodiments and alternatives.

As illustrated in FIG. 3, the counterbalance 230 may include apertures 260*a* and 260*b*, and, as illustrated in FIGS. 4 and 5, the plug bearing 240 may include apertures 280*a*-280*d*. Any of the plug bearing apertures 280*a*-280*d*, or any combination of the plug bearing apertures 280*a*-280*d*, may be configured to align with any of the counterbalance apertures 260*a* and 260*b*, or any combination of the counterbalance apertures 260*a* and 260*b*, each alignment corresponding to a different distance from the axis of rotation R to the floor treating attachment 130. Each distance from the axis of rotation R, in turn, corresponds to a different speed of oscillating motion that may be imparted from the drive shaft 200 to the floor treating attachment 130. Also, the bolt 270 may extend through any of the plug bearing apertures 280*a*-280*d* and any of the counterbalance apertures 260*a* and 260*b* to assist with the connection of the floor treating attachment 130 to the counterbalance 230.

As shown in FIG. 2, for example, the plug bearing aperture 280*a* may align with the counterbalance aperture 260*a*, with the bolt 270 extending through the apertures 280*a* and 260*a*. This alignment may correspond to the distance $d_2$ from the axis of rotation R and to a speed of oscillating motion that is imparted from the drive shaft 200 to the floor treating attachment 130. The plug bearing aperture 280*c* may also be configured to align with the counterbalance aperture 260*a*, with the bolt 270 extending through the apertures 280*c* and 260*a*. This alignment may correspond to a different distance from the axis of rotation R and to a different speed of oscillating motion that is imparted from the drive shaft 200 to the floor treating attachment 130. Thus, different speeds of oscillating motion may be utilized during different applications of the floor treating system 100, such as a higher speed when cleaning a floor quickly is desirable and a lower speed when cleaning a floor with less power is desirable, for example.

Figure 6:
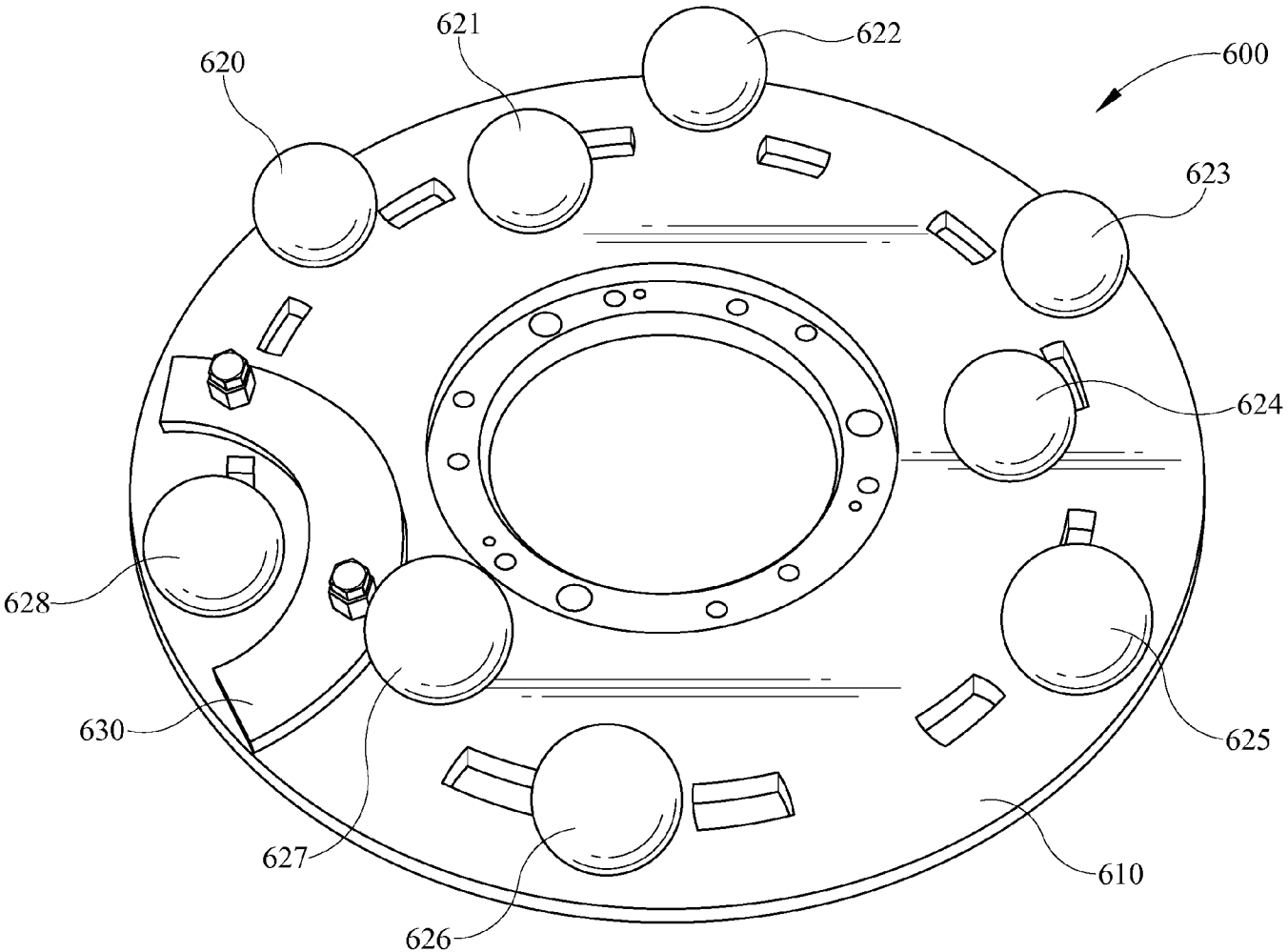
FIG. 6 is a perspective view of a rug beating attachment according to multiple embodiments and alternatives.

Turning to FIG. 6, multiple embodiments of the floor treating system include a rug beating attachment 600 and means for imparting a vibrating motion from the drive shaft to the rug beating attachment 600, in addition to the floor treating attachment and means for imparting an oscillating motion from the drive shaft to the floor treating attachment. The rug beating attachment 600 may be utilized to beat dirt, dust, and other particles from a rug that is placed over a perforated mat or grate, for example.

Also, in multiple embodiments of the bottom portion 110 (shown in FIGS. 1 & 2) of the floor treating system 100, the rug beating attachment 600 takes the place of the floor treating attachment 130. In some embodiments, the means for imparting a vibrating motion from the drive shaft 200 to the rug beating attachment 600 comprise the flywheel 210, the counterbalance 230, and a counterweight 630 configured to attach to the rug beating attachment 600. The counterbalance 230 may connect to the flywheel 210 and the rug beating attachment 600, the counterweight 630 counteracting any reduction in vibrations from the counterbalance 230 and thereby increasing vibrations. In multiple embodiments, the drive shaft 200 of the power source 150 rotates the flywheel 210 around the axis of rotation R, the rotation of the flywheel 210 provides motion to the counterbalance 230, and the counterbalance 230 and the counterweight 630 impart a vibrating motion to the rug beating attachment 600.

In some embodiments, the plug bearing lip 242 extends over part of the rug beating attachment 600 to assist with the connection of the rug beating attachment 600 to the counterbalance 230, while the remainder of the plug bearing 240 is positioned between the rug beating attachment 600 and the counterbalance 230. Any of the plug bearing apertures 280*a*-280*d*, or any combination of the plug bearing apertures 280*a*-280*d*, may be configured to align with any of the counterbalance apertures 260*a* and 260*b*, or any combination of the counterbalance apertures 260*a* and 260*b*, each alignment corresponding to a different distance from the axis of rotation R to the rug beating attachment 600. Also, the bolt 270 may extend through any of the plug bearing apertures 280*a*-280*d* and any of the counterbalance apertures 260*a* and 260*b* to assist with the connection of the rug beating attachment 600 to the counterbalance 230.

Additionally, in some embodiments, the rug beating attachment 600 includes a plate 610 and spheres 620-628 configured to attach to the plate 610. The plate 610 may be manufactured from any of a number of materials, including, but not limited to, polymers. The spheres 620-628 may be manufactured from any of a number of materials, including, but not limited to, phenolic resins, and may attach to the plate 610 with bolts, for example.

It will therefore be readily understood by those persons skilled in the art that the embodiments and alternatives of a floor treating system 100 and method are susceptible to a broad utility and application. While the embodiments are described in all currently foreseeable alternatives, there may be other, unforeseeable embodiments and alternatives, as well as variations, modifications and equivalent arrangements that do not depart from the substance or scope of the embodiments. The foregoing disclosure is not intended to be construed to limit the embodiments or otherwise to exclude such other embodiments, adaptations, variations, modifications and equivalent arrangements, the embodiments being limited only by the claims appended hereto and the equivalents thereof.

What is claimed is:

1. An oscillating, floor treating device comprising:

a power source having a rotatable drive shaft, wherein the rotatable drive shaft rotates around an axis of rotation;

a floor treating attachment; and means for imparting at least two speeds of oscillating motion from the drive shaft to the floor treating attachment, wherein the means for imparting at least two speeds of oscillating motion comprise: a flywheel having an aperture configured to receive the drive shaft; a counterbalance configured to connect to the flywheel; and means for connecting the floor treating attachment to the counterbalance at at least two different distances from the axis of rotation of the drive shaft, wherein the means for connecting the floor treating attachment to the counterbalance comprise: a plug bearing configured to be positioned between the counterbalance and the floor treating attachment; and a bolt, and wherein the counterbalance has an aperture, the plug bearing has at least two different apertures configured to align with the counterbalance aperture, and the bolt is configured to extend through the counterbalance aperture and any of the at least two different plug bearing apertures.

2. The oscillating, floor treating device of claim 1, further comprising at least one weight configured to attach to the counterbalance.

3. The oscillating, floor treating device of claim 1, wherein the floor treating attachment is selected from the group consisting of: a carpet cleaning attachment, a tile cleaning brush, a hardwood sanding attachment, and a vinyl composition tile stripping attachment.

4. The oscillating, floor treating device of claim 1 further comprising:

a housing assembly having a proximal end and a distal end; and a spray system having a spray tank, wherein the spray tank is mounted onto the housing assembly.

5. The oscillating, floor treating device of claim 4 further comprising three wheels, wherein at least one of the wheels is configured to bear the load of the spray tank.

6. The oscillating, floor treating device of claim 5, wherein the at least one wheel configured to bear the load of the spray tank is adjustably mounted onto the housing.

7. The oscillating, floor treating device of claim 4, wherein the spray tank is made from a material selected from the group consisting of: stainless steel and titanium.

8. The oscillating, floor treating device of claim 4, wherein the spray system further comprises:

a pump;

a hose assembly; and a spray head, wherein the pump is located between the spray head and the distal end of the housing assembly.

9. The oscillating, floor treating device of claim 8, wherein the spray head is made from a polymer.

10. The oscillating, floor treating device of claim 8, wherein the spray head is spring mounted onto the housing assembly.

11. The oscillating, floor treating device of claim 8, wherein the pump and the hose assembly are substantially enclosed within the housing assembly.

12. An oscillating, floor treating device comprising:

a power source having a rotatable drive shaft, wherein the rotatable drive shaft rotates around an axis of rotation;

a floor treating attachment configured to receive motion from the power source and oscillate at at least two speeds of oscillating motion;

a flywheel having an aperture configured to receive the rotatable drive shaft;

a counterbalance configured to connect to the flywheel;

a plug bearing configured to be positioned between the counterbalance and the floor treating attachment; and a bolt, wherein the floor treating attachment is configured to connect to the counterbalance at at least two different distances from the axis of rotation of the drive shaft, and wherein the plug bearing has at least two different apertures corresponding to the at least two different distances from the axis of rotation of the drive shaft.

13. The oscillating, floor treating device of claim 12, further comprising at least one weight configured to attach to the counterbalance.

14. The oscillating, floor treating device of claim 12, wherein the floor treating attachment is selected from the group consisting of: a carpet cleaning attachment, a tile cleaning brush, a hardwood sanding attachment, and a vinyl composition tile stripping attachment.

15. The oscillating, floor treating device of claim 12 further comprising:

a housing assembly having a proximal end and a distal end; and a spray system having a spray tank, wherein the spray tank is mounted onto the housing assembly.

16. The oscillating, floor treating device of claim 15 further comprising three wheels, wherein at least one of the wheels is configured to bear the load of the spray tank.

17. The oscillating, floor treating device of claim 15, wherein the at least one wheel configured to bear the load of the spray tank is adjustably mounted onto the housing.

18. The oscillating, floor treating device of claim 15, wherein the spray tank is made from a material selected from the group consisting of: stainless steel and titanium.

19. The oscillating, floor treating device of claim 14, wherein the spray system further comprises:

a pump;

a hose assembly; and a spray head, wherein the pump is located between the spray head and the distal end of the housing assembly.

20. The oscillating, floor treating device of claim 19, wherein the spray head is made from a polymer.

* * * * *

UNITED STATES PATENT AND TRADEMARK OFFICE

CERTIFICATE OF CORRECTION

PATENT NO. : 8,356,375 B2
APPLICATION NO. : 12/815523
DATED : January 22, 2013
INVENTOR(S) : John Franklin Geurkink It is certified that error appears in the above-identified patent and that said Letters Patent is hereby corrected as shown below:

In the Claims:

Column 6, Claim 17, line 25, the claim reference numeral "15" should read --16--.

Column 6, Claim 19, line 31, the claim reference numeral "14" should read --15--.

Signed and Sealed this
Twenty-third Day of April, 2013

Teresa Stanek Rea
*Acting Director of the United States Patent and Trademark Office*